US005460332A

United States Patent [19]

Frick

[11] Patent Number: 5,460,332

[45] Date of Patent: Oct. 24, 1995

[54] MOBILE CRUSHER

[76] Inventor: Dietmar Frick, Nägele 3, A-6842 Koblach, Austria

[21] Appl. No.: 992,077

[22] Filed: Dec. 17, 1992

[30] Foreign Application Priority Data

Dec. 18, 1991 [AU] Australia ..... 2503/91

[51] Int. Cl.[6] ..... B02C 21/02

[52] U.S. Cl. ..... 241/101.74; 241/266

[58] Field of Search ..... 241/101.7, 266

[56] References Cited

U.S. PATENT DOCUMENTS

| | | | |
|---|---|---|---|
| 1,611,026 | 12/1926 | Gustapson | 241/101.7 X |
| 1,611,128 | 12/1926 | Gunnison | 241/101.7 X |
| 2,256,731 | 9/1941 | Winther | 241/101.7 X |
| 2,593,353 | 4/1952 | Shelton, Jr. | 241/101.7 X |
| 2,864,561 | 12/1958 | Mork | 241/101.7 X |
| 3,190,571 | 6/1965 | Kimball | 241/101.7 X |
| 3,647,150 | 3/1972 | Shephanek | 241/101.7 X |
| 3,848,818 | 11/1974 | Vaillant et al. | 241/101.7 |
| 3,983,950 | 10/1976 | Fabian | 241/101.7 X |
| 4,101,081 | 7/1978 | Ritter | 241/101.7 |
| 4,383,651 | 5/1983 | Couperus | 241/101.7 X |
| 4,903,903 | 2/1990 | Benen | 241/101.7 |
| 4,997,135 | 3/1991 | Zehr | 241/101.7 |

FOREIGN PATENT DOCUMENTS

| | | | |
|---|---|---|---|
| 3227834A1 | 1/1984 | Germany . | |
| 8534877.5 | 12/1985 | Germany . | |
| 3819864C1 | 4/1989 | Germany . | |
| 3904501A1 | 8/1990 | Germany . | |
| 443681 | 9/1974 | U.S.S.R. | 241/101.7 |
| 2141636 | 5/1984 | United Kingdom . | |

*Primary Examiner*—Frances Han
*Attorney, Agent, or Firm*—Friedrich Kueffner

[57] ABSTRACT

A mobile crusher includes a caterpillar-type undercarriage and a chassis frame mounted on the undercarriage. A motor-driven crushing tool is mounted in the chassis frame. A hopper is connected to the chassis frame, so as to be swingable relative to the undercarriage about a horizontal axis. At least one conveyor for discharging crushed material from the crushing tool is connected to the chassis frame. A downwardly connected kingbolt which can be coupled to a coupling member of a tractor is attached to the underside of the hopper at a location remote from the horizontal axis of the chassis frame. A wheel unit with a plurality of wheels is connected to a conveyor frame which supports the conveyor.

8 Claims, 2 Drawing Sheets

MOBILE CRUSHER

BACKGROUND OF THE INVENTION

1. Field of the Invention

The present invention relates to a mobile crusher with an undercarriage, particularly a caterpillar-type undercarriage, and a motor-driven crushing tool mounted in a chassis frame connected to the undercarriage. The crushing tool may be in the form of a pair of crusher plates which oscillate relative to each other and extend essentially in a vertical direction. The mobile crusher further includes a hopper and at least one conveyor belt for discharging the crushed material, wherein the conveyor belt is mounted so as to be adjustable relative to the chassis frame, and wherein the hopper is mounted so as to be swingable relative to the chassis frame about a horizontal axis.

2. Description of the Related Art

Mobile crushers of the above-described type are known in the art. They are used in quarries for comminuting the produced stone. The crusher is also used for comminuting material from demolished buildings. Units of this type are extremely large and heavy. They may have a height of up to and above 4 meters, a length of approximately 16 meters, and a weight of approximately 45 tons. The crushers can be moved at the location where they are used by means of their undercarriage, which usually is constructed as a caterpillar-type undercarriage. However, these undercarriages are not suitable for traveling on roads. In the past, crushers of this type could only be transported on public roadways on flat-bed trucks with special permits and in a convoy. During such a transport, not only the enormous weight of the crusher acts on the roadway, but the high weight of the flat-bed truck used for transportation additionally acts on the roadway.

DE-OS 39 04 501 describes a mobile crusher for the comminution of demolition material and other rubble. A jaw crusher is mounted in an essentially vertical position, and a feeding device for the crushed material is arranged in the region of the upper crushing mouth of the jaw crusher. The feeding device has a feed hopper and a vibrating conveyor. The undercarriage is additionally provided with a discharge conveyor whose feeding end is arranged in a low position underneath the crusher outlet. The feeding device for the crushed material is mounted so as to be vertically adjustable and can be lowered by means of a lifting device from a high position for feeding material into the jaw crusher into a low position in which it does not project or only insignificantly projects above the jaw crusher. The jaw crusher is arranged on a caterpillar-type undercarriage. It is the purpose of this known construction to provide a mobile crusher which has relatively compact dimensions during transportation and which particularly has a reduced transportation height, as compared to older units, so that the mobility of the crusher is increased. However, this object is only insufficiently met by the known construction because, for transporting this known unit on public roadways, it is still required to use flat-bed trucks and to obtain special permits.

SUMMARY OF THE INVENTION

Therefore, it is the object of the present invention to provide a mobile crusher of the above-described type which is capable in a simple manner of traveling on public roadways without requiting special permits for each individual transport and without increasing the load acting on the roadway.

In accordance with the present invention, a kingbolt of a tractor/trailer-type coupling is fastened to the underside of the hopper, wherein the kingbolt is located in the longitudinal center plane of the hopper and at an end of the hopper remote from the axis about which the hopper is swingably mounted. The conveyor belt is supported by a frame to which is connected in an articulated manner a unit with preferably a plurality of wheels.

In accordance with a useful development of the present invention, the wheel unit has a plurality of wheel axles which are located adjacent to each other and are spring-mounted in a frame. The frame of the wheel unit has on its upper side and preferably in its longitudinal center area a pair of bearing lugs which can be connected by means of bolts or shafts to bearing lugs attached to the frame of the conveyor belt. This configuration makes it possible to distribute and support the substantial weight of such a crusher over a large surface area and to effect the connection between the frame of the conveyor belt and the frame of the wheel unit in a very simple manner because, when the connection is to be made, only the bolts or shafts have to be inserted and secured by cotter pins.

In accordance with another feature of the invention, the bolts or shafts connecting the frame of the conveyor belt and the frame of the wheel unit extend parallel to the axis about which the hopper is swingable. As a result, the manipulations and measures required for preparing the crusher for travel on roads are reduced to a minimum.

In accordance with another advantageous feature, the upper edge of the hopper facing the crushing tool extends downwardly inclined toward the chassis frame which includes the crushing tool and the drive motor therefor, and the angle of inclination of the inclined upper edge of the hopper corresponds essentially to the angle of inclination of the kingbolt relative to the vertical. As a result, the crusher has in its position of transportation its lowest possible structural height.

Another advantageous feature of the present invention for reducing the length of the crusher for transportation provides that the frame supporting the conveyor belt is composed in its longitudinal direction of at least two sections which are swingable relative to each other. The frame of the wheel unit is connected to the conveyor belt in or near the area of the portion of the conveyor belt where a piston-cylinder unit acts on the conveyor belt for vertically pivoting the conveyor belt.

In order to ensure that a wide and free pivoting range is available for the hopper, the hopper and the conveyor belt are mounted on opposite sides of the chassis frame and the crushing tool mounted in the chassis frame. As a result, the hopper can be changed without problems and without requiring additional assembly or disassembly operations from its position of operation into its transportation position.

Even though it is advantageous to mount the conveyor belt and its frame so as to be pivotable in a vertical plane, so that during operation the point of discharge of the crushed material can be adjusted and can be adapted to the respective operating conditions as much as possible, the present invention could also be utilized in a crusher in which the conveyor belt is mounted fixed relative to the chassis frame if the mechanism connecting the conveyor belt and the wheel unit is constructed so as to be vertically adjustable. In this case, the wheel unit may remain arranged connected to the frame of the conveyor belt even during operation of the crusher because, if the frame of the conveyor belt is mounted so as to be pivotable, the adjustments of the conveyor belt required by the operation can be achieved by means of this vertically adjustable mechanism.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

Figure 1:
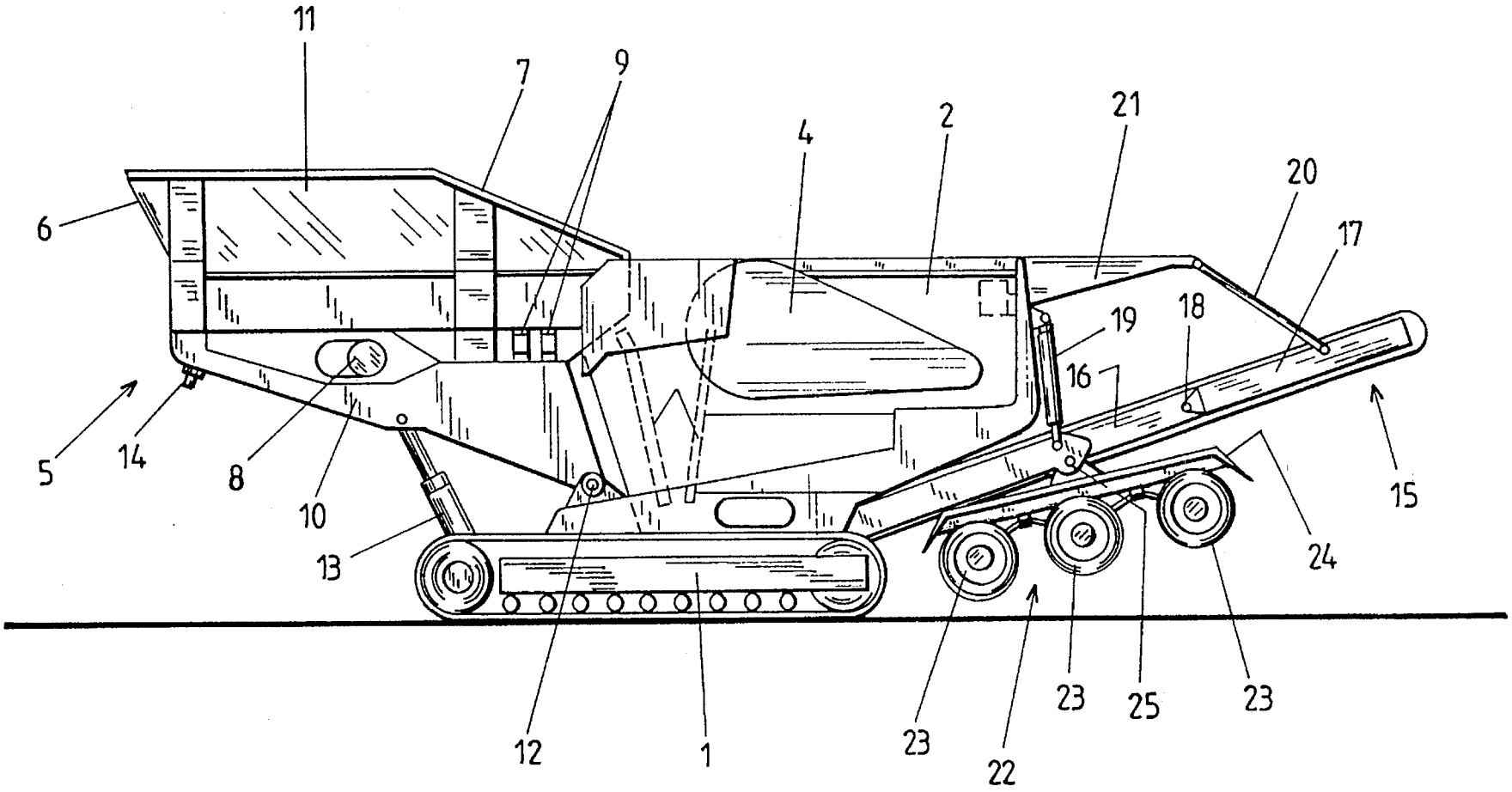
FIG. 1 is a schematic elevational side view of the crusher according to the present invention in its position of operation.

FIG. 1 of the drawing shows the crusher according to the present invention during operation. A chassis frame 2 is connected to a caterpillar-type undercarriage 1. The chassis frame 2 includes a high-power drive unit, not shown in detail. The actual crushing tool 3 is composed of two plates which extend essentially perpendicularly relative to the plane of the drawing and which are indicated by broken lines in FIG. 1. One of the two plates of the crushing tool 3 is mounted stationary in the chassis frame 2. The above-mentioned drive unit, which is not illustrated, a fly wheel, and a V-belt drive are used for imparting an oscillating movement on the other plate of the crushing tool 3, so that this plate is moved periodically back and forth within the plane of the drawing relative to the stationary plate. The fly wheel and the V-belt drive are covered by a housing 4.

A hopper 5 is provided on one side of the crushing tool 3. The specific configuration of the crushing tool is not significant in connection with the present invention. The upper portion 11 of the hopper 5 is formed by outwardly directed end walls 6, which define a funnel-shaped filling area, wherein a portion of the upper edge 7 which faces the crushing tool 3 extends obliquely downwardly toward the chassis frame 2. A horizontal grid which permits small material to fall through is arranged within the upper portion 11 of the hopper 5 and above the upper edge of the crushing tool 3. The upper portion 11 of the hopper 5 may be vibrated by means of a vibrator 8. The upper portion 11 of the hopper 5 is supported relative to its support part 10 by means of elastic support members 9. Within the scope of the present invention, the hopper 5 is formed by the upper portion 11 and the support part 10.

The hopper 5 or its support part 10 is mounted so as to be swingable about a horizontal axis 12. The axis 12 is located adjacent the undercarriage 11 and approximately in the middle third of the length of the undercarriage 1. The hopper 5 is swingable by means of a piston-cylinder unit 13 which is hinged to the support part 10, on the one hand, and to the chassis frame or undercarriage frame, on the other hand. On the side of the hopper 5 or its support part 10 facing away from the axis 11, and in the vertical longitudinal center plane of the hopper 5, a kingbolt 14 which is inclined relative to the vertical is attached to the underside of the hopper 5. The kingbolt 14 forms part of a coupling of the type used for connecting tractors and trailers. The angle by which the kingbolt 14 is inclined to the vertical corresponds to the angle of the inclination of the upper edge 7 of the upper portion 11 of the hopper 5.

A conveyor belt 15 is pivotally attached to the side of the chassis frame 2 which faces away from the hopper 5. The conveyor belt 15 is pivotable about a horizontal axis located at the undercarriage 1. The conveyor belt 15 extends into the outlet area of the crushing tool 3 and picks up the material comminuted by the crushing tool 3 at this outlet area. The conveyor belt 15 additionally picks up the material which fell through the grid of the upper portion 11 of the hopper 5. The frame of the conveyor belt 15 is composed of two sections 16 and 17 which are pivotable relative to each other about a horizontal axis 18. The section 16 is supported by a piston-cylinder unit 19, and the front section 17 of the conveyor belt 15 or of the frame thereof is hinged to a link member 20 which, with its other end, is attached to a cantilever arm 21 of the chassis frame 2.

A wheel unit 22 is connected in an articulated manner to that portion of the section 16 which is acted on by the piston-cylinder unit 19. In the illustrated embodiment, the wheel unit 22 includes three spring-mounted wheel axles 23 which are arranged next to each other and which are received by a frame 24. Beating lugs 25 are welded to the upper side of the frame 24. The beating lugs 25 receive bolts or shafts which extend parallel to the axis 12 about which the hopper 5 is swingable. The connection between the wheel unit 22 and the section 16 of the frame of the conveyor belt 15 is constructed in such a way that it can be easily separated without requiting special tools. The structural height of the crusher illustrated in the drawing is more than four meters. The total length of the crusher is approximately 16 meters, and the weight of a crusher of this type is approximately 45 tons.

Figure 2:
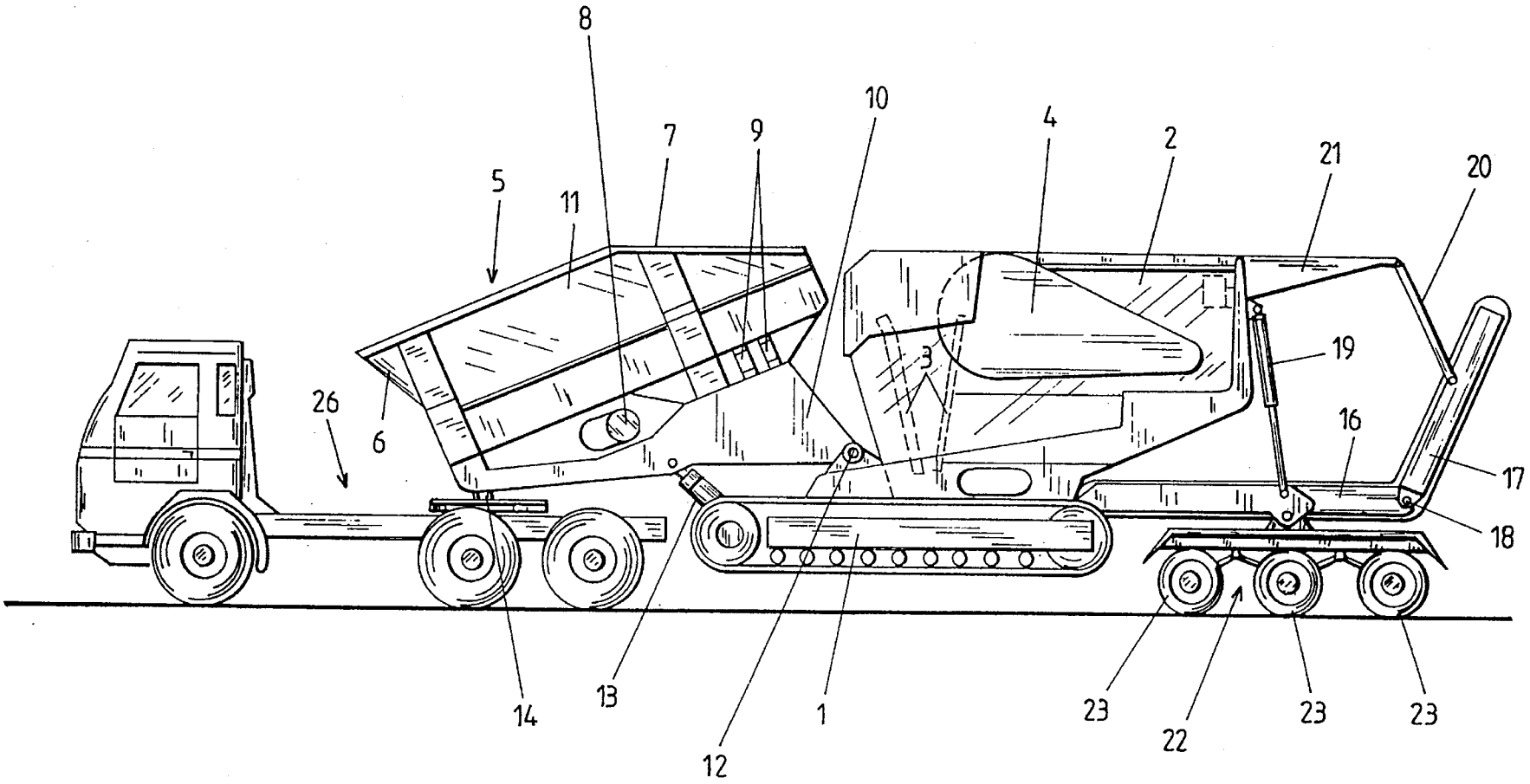
FIG. 2 is a side view of the crusher of FIG. 1 shown in its position of transportation and coupled to a tractor.

As mentioned above, FIG. 1 shows the mobile crusher of the present invention in its position of operation. A tractor 26 which is illustrated in FIG. 2 is used when the crusher is to be transported on public roadways. The tractor is moved toward the crusher on the side of the hopper 5. By actuating the piston-cylinder unit 13, the hopper 5 is lowered about the axis 12 in a counterclockwise direction, as seen in FIGS. 1 and 2 of the drawing, until the kingbolt 14 engages a coupling member of the tractor.

By actuating the piston-cylinder unit 19, the conveyor belt 15 is lowered, and the end section 17 of the conveyor belt 15 is folded upwardly by means of the link member 20. The conveyor belt 15 or its frame are lowered by means of the piston-cylinder unit 19 until the wheel unit 22 rests on the ground. A further actuation of the above-mentioned piston-cylinder units 13 and 19 has the result that the middle portion of the entire mobile crusher is raised, so that the undercarriage 1 is raised above the ground. The crusher can now travel in the same manner as a tractor/trailer.

In the illustrated embodiment, the wheel unit 22 is connected directly to the section 16 of the conveyor belt or its frame by means of bolts or shafts. It is basically also possible to arrange a vertically adjustable mechanism between the section 16 and the wheel unit 22, so that the wheel unit 22 rests on the ground even when the crusher is in operation and the frame of the conveyor belt 15 is supported relative to the wheel unit 22. In this case, the piston-cylinder unit 19 is not required. However, the vertically adjustable mechanism must be constructed in such a way that it can absorb without torsion any lateral forces acting on the wheel unit during travel on a road.

In the embodiment illustrated in FIG. 1, the wheel unit 22 is attached to the conveyor belt 15 even if the conveyor belt 15 is raised. The connection between wheel unit 22 and section 16 of the frame of the conveyor belt 15 can also be constructed in such a way that this connection can be separated when the conveyor belt is lowered, so that the conveyor belt can then be raised during the operation of the crusher without the wheel unit being attached thereto.

The drawing also shows that hopper 5, crushing tool 3, chassis frame 2, and conveyor belt 15, as well as undercarriage 1, are located in a plane, i.e., they do not extend at an angle relative to each other. However, crushers of this type are known in which the aforementioned units are arranged at an angle relative to each other. The proposal according to the present invention can also be used in such a case, however, it is then necessary to arrange those components which are arranged at an angle relative to the undercarriage, so as to be pivotable about vertical axes, so that all these components are in a vertical plane during travel on a road or can be folded or pivoted into such a vertical plane.

It should be understood that the preferred embodiments and examples described are for illustrative purposes only and are not to be construed as limiting the scope of the present invention which is properly delineated only in the appended claims.

I claim:

1. A mobile crusher comprising a caterpillar type undercarriage, a chassis frame mounted on the undercarriage, a motor-driven crushing tool mounted in the chassis frame, the chassis frame having a horizontal axis at a side thereof and adjacent the undercarriage, a hopper connected to the chassis frame at the axis of the chassis frame such that the hopper is swingable relative to the undercarriage, at least one conveyor for discharging crushed material from the crushing tool, the at least one conveyor being connected to the chassis frame so as to be pivotable relative to the chassis frame and being supported by a conveyor frame, the hopper having a bottom side, a downwardly directed kingbolt adapted for coupling with a coupling member of a tractor, the kingbolt being attached to the bottom side at a location remote from the horizontal axis, and a wheel unit comprising a plurality of wheels being connected to the conveyor frame.

2. The mobile crusher according to claim 1, wherein the crushing tool comprises a pair of essentially vertically arranged crushing plates and means for oscillating the crushing plates relative to each other.

3. The mobile crusher according to claim 1, wherein the wheel unit comprises a wheel unit frame, a plurality of wheel axles spring-mounted in the wheel unit frame, the wheel axles being arranged next to each other, the wheel unit frame having an upper side and a longitudinal direction, a pair of bearing lugs being attached to the upper side of the wheel unit frame and approximately in the middle of the longitudinal direction of the wheel unit frame, the conveyor frame having a bottom side, bearing lugs being attached to the bottom side of the conveyor frame, the bearing lugs of the conveyor frame and the wheel unit frame being connected to each other by means of bolts extending through the lugs.

4. The mobile crusher according to claim 3, wherein the bolts connecting the conveyor frame and the wheel unit frame extend parallel to the horizontal axis of the chassis frame.

5. The mobile crusher according to claim 1, wherein the hopper has an upper edge, wherein at least a portion of the upper edge adjacent the crushing tool is inclined downwardly toward the chassis frame, wherein an angle of inclination of the inclined portion of the upper edge essentially corresponds to an angle of inclination of the kingbolt relative to the vertical.

6. The mobile crusher according to claim 1, comprising a piston-cylinder unit for pivoting the conveyor relative to the chassis frame, the conveyor frame comprising at least two sections extending in longitudinal direction thereof, the two sections being pivotally connected to each other, wherein the wheel unit is connected to the conveyor frame essentially at a location at which the piston-cylinder unit is connected to the conveyor frame.

7. The mobile crusher according to claim 1, wherein the hopper and the conveyor are mounted on opposite sides of the chassis frame.

8. The mobile conveyor according to claim 1, wherein the conveyor is mounted stationary relative to the chassis frame, further comprising an essentially vertically adjustable mechanism connecting the conveyor and the wheel unit.

* * * * *